US010856589B1

(12) United States Patent
Lee

(10) Patent No.: US 10,856,589 B1
(45) Date of Patent: Dec. 8, 2020

(54) SAFETY GARMENT WITH LIGHTS

(71) Applicant: Starlite Electric Inc., San Francisco, CA (US)

(72) Inventor: William Lee, San Francisco, CA (US)

(73) Assignee: Starlite Electric Inc., San Francisco, CA (US)

( * ) Notice: Subject to any disclaimer, the term of this patent is extended or adjusted under 35 U.S.C. 154(b) by 276 days.

(21) Appl. No.: 16/148,807

(22) Filed: Oct. 1, 2018

(51) Int. Cl.

| | |
|---|---|
| ***F21V 33/00*** | (2006.01) |
| ***A41D 13/01*** | (2006.01) |
| ***F21V 23/00*** | (2015.01) |
| ***A41D 1/04*** | (2006.01) |
| ***A41D 1/00*** | (2018.01) |
| ***A41D 27/20*** | (2006.01) |
| ***F21V 23/04*** | (2006.01) |
| *F21Y 105/10* | (2016.01) |
| *F21Y 115/10* | (2016.01) |

(52) U.S. Cl.
CPC ..... *A41D 13/01* (2013.01); *A41D 1/002* (2013.01); *A41D 1/04* (2013.01); *A41D 27/20* (2013.01); *F21V 23/001* (2013.01); *F21V 23/0435* (2013.01); *F21V 33/0008* (2013.01); *F21V 33/0064* (2013.01); *F21Y 2105/10* (2016.08); *F21Y 2115/10* (2016.08)

(58) Field of Classification Search
CPC ..... F21V 33/0008; F21V 21/0816
USPC ..... 362/570, 103–108
See application file for complete search history.

(56) References Cited

U.S. PATENT DOCUMENTS

| | | | | |
|---|---|---|---|---|
| 7,758,200 | B2 * | 7/2010 | Tuan | F21V 33/0008 362/103 |
| 2014/0022766 | A1 * | 1/2014 | Wright | G08B 5/004 362/108 |
| 2015/0016095 | A1 * | 1/2015 | Kretzu | B62J 6/00 362/108 |
| 2015/0176825 | A1 * | 6/2015 | Bernstein | F21V 23/0407 362/103 |
| 2016/0021945 | A1 * | 1/2016 | Richmond | F21V 23/0414 362/103 |

* cited by examiner

*Primary Examiner* — William J Carter
(74) *Attorney, Agent, or Firm* — Staniford Tomita LLP

(57) ABSTRACT

A safety garment includes a base layer, and a horizontal, first vertical, and second vertical strip attached to the base layer, and a first and second strip of lighting elements attached to the base layer. The first vertical strip forms at least a first intersection with the horizontal strip. The second vertical strip forms at least a second intersection with the horizontal strip. The first strip of lighting elements is positioned along an outer edge of the first vertical strip. The second strip of lighting elements is positioned along an outer edge of the second vertical strip. A wiring assembly is routed between the base layer and the horizontal strip. An end of the wiring assembly connects to an end of the first vertical strip at the first intersection. Another end of the wiring assembly connects to an end of the second vertical strip at the second intersection.

18 Claims, 7 Drawing Sheets

SAFETY GARMENT WITH LIGHTS

TECHNICAL FIELD

The present invention relates generally to safety equipment, and, more particularly, to a safety garment with lights.

BACKGROUND

High-visibility clothing refers to a type of personal protective equipment that is designed to be easily discernable and conspicuous during the daytime, nighttime, or other low-light conditions. Such clothing may be worn by, for example, railway and highway workers, airport workers, first responders, runners, cyclists, or any other individual exposed to hazards due to problems with visibility. Such hazards may include, for example, motor vehicles, heavy construction equipment, and so forth.

Nonetheless, accidents still occur. Thus, there is a continuing need for improved safety clothing that not only increases visibility, but is also comfortable to wear and does not interfere with the user's freedom of movement and other functions.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF DESCRIPTION OF THE FIGURES

In the following drawings like reference numerals designate like structural elements. Although the figures depict various examples, the one or more embodiments and implementations described herein are not limited to the examples depicted in the figures.

FIG. 1A shows an enlarged view of a section of the safety garment according to one or more embodiments.

DETAILED DESCRIPTION

A detailed description of one or more embodiments is provided below along with accompanying figures that illustrate the principles of the described embodiments. While aspects of the invention are described in conjunction with such embodiment(s), it should be understood that it is not limited to any one embodiment. On the contrary, the scope is limited only by the claims and the invention encompasses numerous alternatives, modifications, and equivalents. For the purpose of example, numerous specific details are set forth in the following description in order to provide a thorough understanding of the described embodiments, which may be practiced according to the claims without some or all of these specific details. For the purpose of clarity, technical material that is known in the technical fields related to the embodiments has not been described in detail so that the described embodiments are not unnecessarily obscured.

Figures 1, 2:
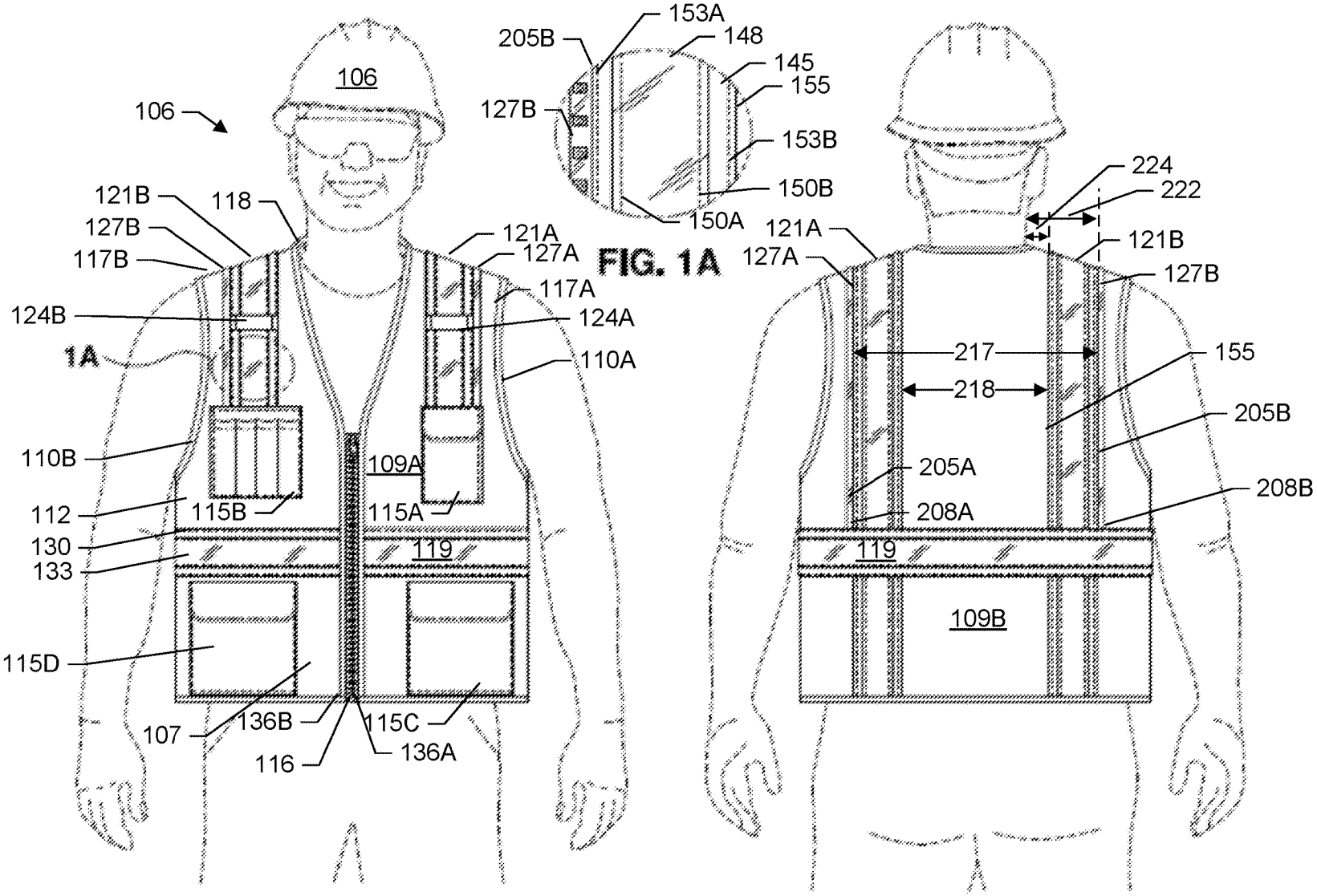
FIG. 1 shows a front view of a safety garment with lights according to one or more embodiments.
FIG. 2 shows a back view of the safety garment according to one or more embodiments.

FIGS. 1 and 2 show front and back views, respectively, of a safety garment 103 being worn by a user 106. The safety garment is designed to substantially cover a torso of the user and may be sized to fit over the user's clothing. The user may be, for example, a construction worker, highway maintenance worker, public utilities worker, emergency responder, police officer, firefighter, airport runway personnel, or any other individual that may be exposed to potential injury hazards due to problems with visibility. For example, such users may be required to work on or near road and highways, during inclement weather (e.g., rain, or fog), and so forth.

There is a need to improve the visibility of such users during the day, in low-light conditions, and at night—while also helping to ensure that the safety garment does not hinder, interfere with or obstruct the user who is wearing the safety garment. It is desirable that the safety garment incorporate the user needs for functionality, comfort, durability, aesthetics, flexibility, safety, and freedom of movement. For example, it is desirable to limit or reduce the presence of loose articles since these may snag on equipment, cause the user to trip and fall, and so forth. It is desirable that the safety garment address user needs for aesthetic comfort. Workers may be more willing to wear safety garments that are aesthetically pleasing as compared to other safety garments that may not be as attractive. Safety garments that take into account not just basic performance requirements, but also other wearability characteristics can improve overall morale and foster a good work environment—which itself can also reduce the number of accidents.

Referring to FIG. 1, in a specific embodiment, this safety garment includes a vest section 107 having a front 109A (FIG. 1) and a back 109B (FIG. 2), opposite the front, a pair of arm receiving openings 110A, B, a base layer fabric 112, and one or more pockets 115A-D attached to the base layer fabric. The base layer fabric may be referred to as a background layer or material.

A fastening mechanism 116 on the front divides, splits, or bisects the front of the vest section into a left side 117A and a right side 117B (as viewed from a perspective of the user when the safety garment is worn). The fastening mechanism allows the left and right sides to be removeably joined so that the user can easily don and doff the safety garment (e.g., easily put the safety garment on, secure the safety garment by fastening the left and right sides together, and easily remove the safety garment by unfastening the left and right sides). When the left and right sides are fastened together, a neck opening 118 is formed through which the user's neck extends. The neck opening may be bounded or closed.

The fastening mechanism may include a first half connected to an edge of the left side, and a second half connected to an edge of the right side. The fastening mechanism allows the first and second halves to be removeably joined. In a specific embodiment, the fastening mechanism includes a zipper. The zipper may include two flexible strips of metal or plastic with interlocking projections. These interlocking projections may be closed or opened by pulling a slide along them. Other fastening mechanisms that may instead or additionally be used include buttons, hook and loop fasteners (e.g., Velcro®), or others.

The pockets allow for the storage of things that may aid the user in the performance of their work. For example, depending upon the nature of the user's work, the pockets may be used to store pens, pencils, markers, measuring tape, utility knife, tape, spare parts, tools, snacks, and so forth.

To improve the visibility of the user, this safety garment includes a set of high visibility elements including reflective materials, florescent colors, contrasting colors, bright colors, retroreflective materials (e.g., a material that reflects and returns a relatively high proportion of light in a direction close to the direction from which it came), combined-performance materials (e.g., a retroreflective material that is also a fluorescent material), active lighting elements or lights (e.g., light emitting diodes (LEDs) powered by an independent power source or battery), or combinations of these.

In a specific embodiment, the location, placement, and positioning of these elements are designed to highlight the human form. By highlighting the human form, operators of other vehicles (e.g., on-coming traffic, heavy equipment) are able to easily recognize an object wearing the safety garment as another human being and, as a result, may take extra precaution. The construction and design features of the safety garment also help to ensure that these high-visibility elements do not interfere with the user or the user's work.

In a specific embodiment, the safety garment satisfies the American National Standard for High-Visibility Safety Apparel and Accessories including ANSI/ISEA 107-2015, ANSI/ISEA 107-2010, or both. These standards provide guidelines for the selection and use of high-visibility safety apparel such as outerwear and safety vests to improve worker visibility during the day, in low-light conditions, and at night. Specifically, the guidelines specify the photometric requirements, minimum amounts of component materials, colors, separation distances, and placement of materials to enhance the visibility of users. A further discussion of the standards and guidelines is provided in "ANSI/ISEA 107-2015, American National Standard for High-Visibility Safety Apparel and Accessories," from the International Safety Equipment Association and is incorporated by reference along with all other references cited.

In a specific embodiment, the base layer or background layer is made from a colored fluorescent material (e.g., fluorescent orange or fluorescent yellow). In a specific embodiment, the base layer includes a mesh material (e.g., polyester mesh material) to facilitate ventilation. In a specific embodiment, the entire base layer may be made from the mesh material. In another specific embodiment, a back portion of the base layer includes the mesh material and a front portion of the base layer includes a solid or non-mesh material (e.g., solid polyester material). In another specific embodiment, the back portion of the base layer includes the solid material and a front portion of the base layer includes the mesh material. A solid material can facilitate the printing of company logos, text, or other the making of other visible markings as there are no small holes for ink to pass through.

As shown in the example of FIG. 1, this safety garment includes a horizontal strip 119 attached to the base layer fabric, a first vertical strip 121A attached to the base layer, a first reflective band 124A attached to the base layer and over the first vertical strip, a first lighting strip 127A attached to the base layer, a second vertical strip 121B attached to the base layer, a second reflective band 124B attached to the base layer and over the second vertical strip, and a second lighting strip 127B attached to the base layer.

In a specific embodiment, the horizontal and vertical strips are attached to the base layer using stitches and the lighting strips are attached to the base layer fabric using an adhesive such as glue.

In a specific embodiment, the horizontal strip includes a background strip of material 130 and a retroreflective strip of material 133 attached (e.g., stitched) to the background strip. The retroreflective strip may positioned along a centerline of the background strip so that it is equidistant from top and bottom edges of the background strip. The width of the retroreflective strip may be narrower than the width of the background strip. The width of the background strip may be about 75 millimeters (mm). The width of the retroreflective strip may be about 50 mm.

A color of the background strip may be different from a color of the base layer for contrast. For example, the color of the background strip may be fluorescent orange and a color of the base layer may be fluorescent yellow. Alternatively, the colors may be swapped. For example, the color of the background strip may be fluorescent yellow and a color of the base layer may be fluorescent orange. The horizontal strip may be referred to as a contrasting and reflective strip because it includes a reflective strip and a background strip in a color that contrasts with a color of the base layer.

The horizontal strip may be located such that it substantially corresponds to the user's waist to help to define a girth of a human torso. For example, the horizontal strip may be located closer to a bottom of the safety garment as compared to a top of the safety garment. The horizontal strip may begin at a first edge 136A of the fastening mechanism and extend substantially around the front and back (see, e.g., FIG. 2) of the vest section and terminate at a second edge 136B of the fastening mechanism, opposite the first edge of the fastening mechanism.

The horizontal strip may be positioned above pockets 115C and 115D. The horizontal strip may be positioned between pockets 115B and 115D, and between pockets 115A and 115C. Pockets 115C, D may be closer to a bottom edge of the garment than pockets 115A, B. A distance between the horizontal strip and pocket 115D may be less than a distance between the horizontal strip and pocket 115B. A distance between the horizontal strip and pocket 115C may be less than a distance between the horizontal strip and pocket 115A.

In a specific embodiment, the first vertical strip may be similar in construction to the horizontal strip. For example, the first vertical strip may likewise include a background strip of material and a retroreflective strip of material attached (e.g., stitched) to the background strip. The retroreflective strip may positioned along a centerline of the background strip so that it is equidistant from side edges of the background strip. The width of the retroreflective strip may be narrower than the width of the background strip. The width of the background strip may be about 75 millimeters (mm). The width of the retroreflective strip may be about 50 mm. A color of the background strip may be different from a color of the base layer for contrast. For example, the color of the background strip may be fluorescent orange and a color of the base layer may be fluorescent yellow. Alternatively, the colors may be swapped. For example, the color of the background strip may be fluorescent yellow and a color of the base layer may be fluorescent orange. The vertical strip may be referred to as a contrasting and reflective strip because it includes a reflective strip and a background strip in a color that contrasts with a color of the base layer.

The first vertical strip, however, is positioned to help define a left side of the elongated torso of the human form including a left shoulder portion. The first vertical strip may be orthogonal or perpendicular to the horizontal strip. The first vertical strip may begin at a bottom edge of the vest section (see, e.g., FIG. 2), extend vertically to intersect and pass under the horizontal strip, continue over a left shoulder portion of the vest section, and down the front of the vest section towards a portion of the horizontal strip that is at the front of the vest section (see, e.g., FIG. 1). The first vertical strip may terminate at a top edge of pocket 115A.

In a specific embodiment, the first lighting strip at least partially follows a path of the first vertical strip along an outer edge 205A (FIG. 2) of the first vertical strip. The path of the first lighting strip may be similar to the path of the first vertical strip. In various specific embodiments, the lighting strip may follow an entire length of the vertical strip or a portion of the length of the vertical strip (e.g., 90, 80, 70, 60, 50, 40, 30, 20, or 10 percent of the length of the vertical strip). The lighting elements in the lighting strip allow for increased visibility. The location of the lighting strip along the vertical strip aids in defining a side of the elongated torso and shoulder portion of the human form. The first lighting strip includes electrically powered lighting elements. Thus, visibility is not dependent upon another light source reflecting from the safety garment for the lighting strip to be visible.

More particularly, in a specific embodiment, the first lighting strip begins at an intersection 208A (FIG. 2) formed between the first vertical strip and the horizontal strip. The first lighting strip may be positioned next to or adjacent to the outer edge of the first vertical strip. The first lighting strip may touch or contact an edge the first vertical strip. The first lighting strip may be positioned next to the first vertical strip such that there is no gap or space between the first lighting strip and the first vertical strip.

Locating the lighting strip close to the vertical strip and away from the arm receiving opening helps to ensure that the weight of the lighting strip does not cause the safety garment to inadvertently slip sideways off the user's shoulders. For example, when the safety garment is being worn by the user, the lighting strip may fall between the user's neck and top of the acromion. The location and positioning of the lighting strip allows the lighting strip to be draped over the user's shoulder (e.g., left shoulder). The weight of the lighting strip is thus distributed between the front and back of the safety garment. The safety garment is comfortable to wear because the weight distribution of the lighting strip is sufficient to not cause the safety garment to sag unevenly. Further, the draping of the lighting strips allow for 180 degree visibility (e.g., front and back).

The first lighting strip may be parallel to the first vertical strip. The first lighting strip extends vertically from intersection 208A, over the left shoulder portion of the vest section, and down the front of the vest section towards the portion of the horizontal strip that is at the front of the vest section (see, e.g., FIG. 1). The first lighting strip may terminate at the top edge of pocket 115A.

In a specific embodiment, the second vertical strip and second lighting strip are mirror images of the first vertical strip and first lighting strip, respectively. This helps to ensure, for example, a good distribution of the weight of the safety garment so that the safety garment rests evenly on the user's shoulders, and other benefits.

More particularly, the second vertical strip may likewise include a background strip of material and a retroreflective strip of material attached (e.g., stitched) to the background strip. The retroreflective strip may positioned along a centerline of the background strip so that it is equidistant from side edges of the background strip. The width of the retroreflective strip may be narrower than the width of the background strip. The width of the background strip may be about 75 millimeters (mm). The width of the retroreflective strip may be about 50 mm. A color of the background strip may be different from a color of the base layer to provide contrast. For example, the color of the background strip may be fluorescent orange and a color of the base layer may be fluorescent yellow. Alternatively, the colors may be swapped. For example, the color of the background strip may be fluorescent yellow and a color of the base layer may be fluorescent orange. In a specific embodiment, the horizontal strip, first vertical strip, and second vertical strip have the same color of background strips. In another specific embodiment, the color of the background strips may be different.

The second vertical strip is positioned to help define another or opposite side (e.g., right side) of the elongated torso of the human form including a right shoulder portion. The second vertical strip may be orthogonal or perpendicular to the horizontal strip. The second vertical strip may begin at a bottom edge of the vest section (see, e.g., FIG. 2), extend vertically to intersect and pass under the horizontal strip, continue over a right shoulder portion of the vest section, and down the front of the vest section towards a portion of the horizontal strip that is at the front of the vest section (see, e.g., FIG. 1). The second vertical strip may terminate at a top edge of pocket 115B.

In a specific embodiment, the second lighting strip at least partially follows a path of the second vertical strip along an outer edge 205B (FIG. 2) of the second vertical strip. The path of the second lighting strip may be similar to the path of the second vertical strip. As discussed, the lighting elements in the lighting strip allow for increased visibility. The location of the lighting strip along the vertical strip further aids in defining the elongated torso and shoulder portion of the human form. The spacing between the first and second lighting strips substantially correspond to the shoulder width of a human being.

Thus, when the first and second lighting strips are viewed as a pair, operators of other vehicles can easily distinguish characteristics of the human form such as an elongated torso and pair of shoulders. The second lighting strip, similar to the first lighting strip, includes electrically powered lighting elements. Thus, visibility is not dependent upon another light source reflecting from the safety garment for the lighting strip to be visible.

More particularly, in a specific embodiment, the second lighting strip begins at an intersection 208B (FIG. 2) formed between the second vertical strip and the horizontal strip. The second lighting strip may be positioned next to or adjacent to the outer edge of the second vertical strip. The second lighting strip may touch or contact an edge the second vertical strip. The second lighting strip may be positioned next to the second vertical strip such that there is no gap or space between the second lighting strip and the second vertical strip.

As discussed, locating the lighting strip close to the vertical strip and away from the arm receiving opening (e.g., right arm receiving opening) helps to ensure that the weight of the lighting strip does not cause the safety garment to inadvertently slip sideways off the user's shoulders. For example, when the safety garment is being worn by the user, the lighting strip may fall between the user's neck and top of the acromion. The location and positioning of the lighting strip allows the lighting strip to be draped over the user's shoulder (e.g., right shoulder). The weight of the lighting strip is thus distributed between the front and back of the safety garment. The safety garment is comfortable to wear because the weight distribution of the lighting strip is sufficient to not cause the safety garment to sag unevenly. The placement and location of the lighting strips are also aesthetically comfortable which contributes to the overall wearability of the safety garment.

The second lighting strip may be parallel to the second vertical strip. The second lighting strip extends vertically from intersection 208B, over the right shoulder portion of the vest section, and down the front of the vest section towards the portion of the horizontal strip that is at the front of the vest section (see, e.g., FIG. 1). The second lighting strip may terminate at the top edge of pocket 115B.

The first and second vertical strips, and first and second lighting strips may be parallel to each other. For example, the first and second lighting strips may be evenly spaced from each other along the lengths of the lighting strips. Lengths of the vertical strips may be at least the lengths of the lighting strips. In a specific embodiment, the lengths of the vertical strips are greater than the lengths of the lighting strips. In another specific embodiment, lengths of the vertical strips are equal to the lengths of the lighting strips. In a specific embodiment, a lighting strip and a vertical strip have at least one of the same or common starting or ending positions or locations. In another specific embodiment, a lighting strip and a vertical strip have the same or common starting and ending positions or locations.

In a specific embodiment, an end of a lighting strip is at or corresponds to an intersection formed between a vertical strip and a horizontal strip. The lighting strip continues uninterrupted to its opposite end. The opposite end of the lighting strip corresponds to an end of the vertical strip, opposite the intersection. In other words, the lighting strip may form a continuous and unbroken line from the intersection of the vertical strip and horizontal strip to a first end of the vertical strip. A distance between the first end and the intersection may be greater than a distance between the intersection and a second end of the vertical strip, opposite the first end.

FIG. 1A shows an enlarged view of the lighting strip (e.g., second lighting strip) and vertical strip (e.g., second vertical strip). As shown in the example of FIG. 1A, the second vertical strip includes a background strip of material 145 and a retroreflective strip of material 148. A pair of vertical stitches 150A, B attach the retroreflective strip to the background strip. A pair of vertical stitches 153A, B, in turn, attach the background strip to the base layer material.

As discussed above, in a specific embodiment, the first and second lighting strips are positioned along outer edges of the first and second vertical strips, respectively. For example, as shown in FIG. 1A, second lighting strip 127B is attached to the base layer and along outer edge 205B of the second vertical strip. A distance 222 (FIG. 2) between outer edge 205B of the second vertical strip and neck opening 118 (FIG. 1) is greater than a distance 224 between an inner edge 155 of the second vertical strip, opposite the outer edge, and the neck opening.

In other words, the outer edge of the vertical strip is further from the neck opening than the inner edge of the vertical strip. For example, referring now to FIG. 2, a first distance 217 is between the first outer edge of the first vertical strip and the second outer edge of the second vertical strip. A second distance 218 is between the inner edge of the first vertical strip and the inner edge of the second vertical strip. The first distance is greater than the second distance. The second distance is less than the first distance.

Positioning or locating the lighting strip along the outer edge of the vertical strip helps to prevent glare from the lighting elements. The positioning along the outer edge of the vertical strip helps to prevent the lighting elements of the lighting strip from shining into the user's eyes and thus adversely affecting the user's vision. In another specific embodiment, a lighting strip may be located along an inner edge of a vertical strip.

In a specific embodiment, the lighting elements of the lighting strips are light emitting diodes (LEDs). In this specific embodiment, the LED chips are mounted to a flexible substrate or circuit board. This allows the lighting strip to bend, flex, and follow the contours of the user's shoulders. The LEDs may be encased or sealed in a flexible silicone covering to provide waterproofing. In a specific embodiment, the lighting strips satisfy Ingress Protection (IP) rating 65. A lighting strip may include lighting elements all having the same single color (e.g., white). A lighting strip may include lighting elements having different colors such as red, green, or blue. The colors can be mixed to show different colors. The lighting strip may be designed to operate on 12-volt direct current (DC) power.

The lighting strip may be connected to a controller that controls the operation of the lighting elements such as the colors that are shown, lighting patterns (e.g., solid, flashing, blinking, pulsing, and so forth), brightness levels, and so forth. A lighting strip may include a set of lighting elements disposed in a continuous linear arrangement or single line. In a specific embodiment, the density of lighting elements is 30 lighting elements per meter. In another specific embodiment, the density of lighting elements is 60 lighting elements per meter. It should be appreciated, however, that the density may vary greatly. In a specific embodiment, the lighting strip measures approximately 10 mm wide and 2 mm tall. Thus, the lighting strip is relatively narrow. This allows the lighting strips to be placed alongside the vertical strips and facilitate defining the elongated torso and shoulders of the human form.

In a specific embodiment, the lighting strips and other components of the safety garment are available as an off-the-shelf purchase. This design feature helps to lower the manufacturing costs of the safety garment. In this specific embodiment, the lighting strip may include a double-sided backing tape so that the lighting strip can be secured to a surface (e.g., base layer fabric of the safety garment). The lighting strips may be purchased in bulk lengths and then cut to size. The lighting strip may include markings such as ruler markings along a length of the lighting strip and cut-lines perpendicular to the ruler markings. One example of an off-the-shelf lighting strip that may be suitable is part number R60x0AA-xxx from LEDSupply of Randolph, Vt.

Figure 3:
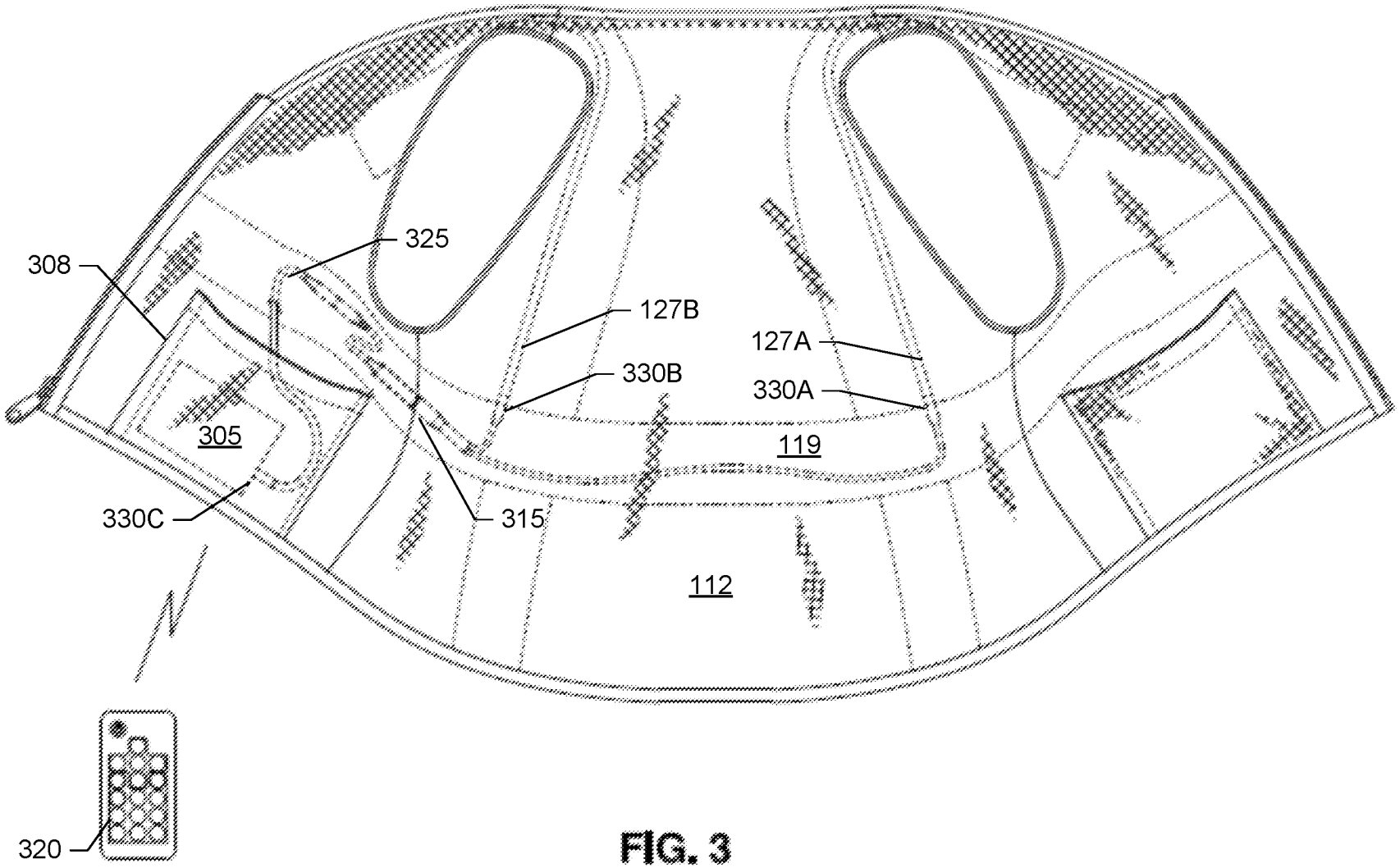
FIG. 3 shows an inside view of the safety garment according to one or more embodiments.

FIG. 3 shows an inside view of the safety garment. As shown in the example of FIG. 3, the safety garment includes a battery 305 stored in a front inside pocket 308 of the safety garment, lighting controller 315, wireless remote 320, and a wiring assembly or harness 325. Locating the battery in the front inside pocket provides the user with easy access to the battery.

The lighting controller is connected in-line between the battery and the pair of lighting strips (e.g., first and second lighting strips 127A,B). The lighting controller is responsible for controlling the operation of the lighting strips. This may include, for example, powering the lighting elements on or off, selecting a lighting color, selecting a brightness level (e.g., bright versus dim), selecting a display mode (e.g., solid, flashing, or pulse), and so forth.

The wireless remote is paired to the lighting controller. The wireless remote includes buttons that the user can use to send signals or commands wirelessly to the lighting controller.

The lighting controller and wireless remote may be optional and may not be included in one or more other embodiments. Thus, lighting strips may be directly connected to the battery via the wiring assembly. In a specific embodiment, the battery may include an on/off switch. The user can use the switch to toggle the lighting strip on/off. In another specific embodiment, the battery may include an integrated lighting controller that may be used to control various options of the lighting strips (e.g., displaying different colors, adjusting brightness levels, alternating among flashing patters, and so forth).

In a specific embodiment, the battery is a rechargeable battery such as a rechargeable lithium-ion battery. In a specific embodiment, the battery may designed to receive an input of 12.6 VDC and provide an output of 12.6-10.8 VDC and have a capacity of 6800 milliampere (mAh). In another specific embodiment, the battery may have a capacity of 9800 mAh. It should be appreciated, however, that the capacity of the battery used may vary greatly. In a specific embodiment, the battery is to be carried about by the user. So, it is desirable that the battery be relatively small and lightweight. A higher capacity battery can provide a longer runtimes than a lower capacity battery. The higher capacity battery, however, may be heavier and larger in size than the lower capacity battery. Factors that may be used to determine battery capacity include, for example, battery dimensions and weight, desired runtime, expected working conditions, and so forth.

The wiring assembly electrically connects the battery, optional lighting controller, and first and second lighting strips 127A, B together. In a specific embodiment, the wiring assembly includes first, second, and third ends 330A, B, C. The first and second ends of the wiring assembly are connected to ends of the first and second lighting strips, respectively. In a specific embodiment, an end of the wiring assembly may be connected to an end of the lighting strip via soldering. The soldered joint may then be sealed such as via heat shrinkable tubing or wrap.

Sealing the joint helps to prevent moisture from entering and electrical arcing. It should be appreciated, however, that any competent technique to electrically couple the wiring assembly to the lighting strip may be used (e.g., electrical tape, wirenuts, solderless clamps, and so forth). The third end of the wiring assembly is connected to the battery. The third end of the wiring assembly may include a plug that can be inserted into a socket of the battery. This allows the user to detach the battery from the wiring assembly. Thus, a depleted battery can be easily replaced with a full battery. It should appreciated that the location of the plug and socket components may be swapped. In a specific embodiment, the battery may include other ports such as a universal serial bus (USB) port. The USB port can be used to help supply power to other portable devices that the user may have such as a cell phone.

In a specific embodiment, at least a portion of the wiring assembly is routed between base layer 112 and horizontal strip 119. In other words, the at least a portion of the wiring assembly may be sandwiched between the base layer and the horizontal strip. The at least a portion of the wiring assembly may be hidden or concealed between the base layer and the horizontal strip. This routing helps to reduce the presence of loose and exposed wires and thus the probability of a wire becoming snagged or caught on other objects such as tools that the user may be carrying.

Figure 4:
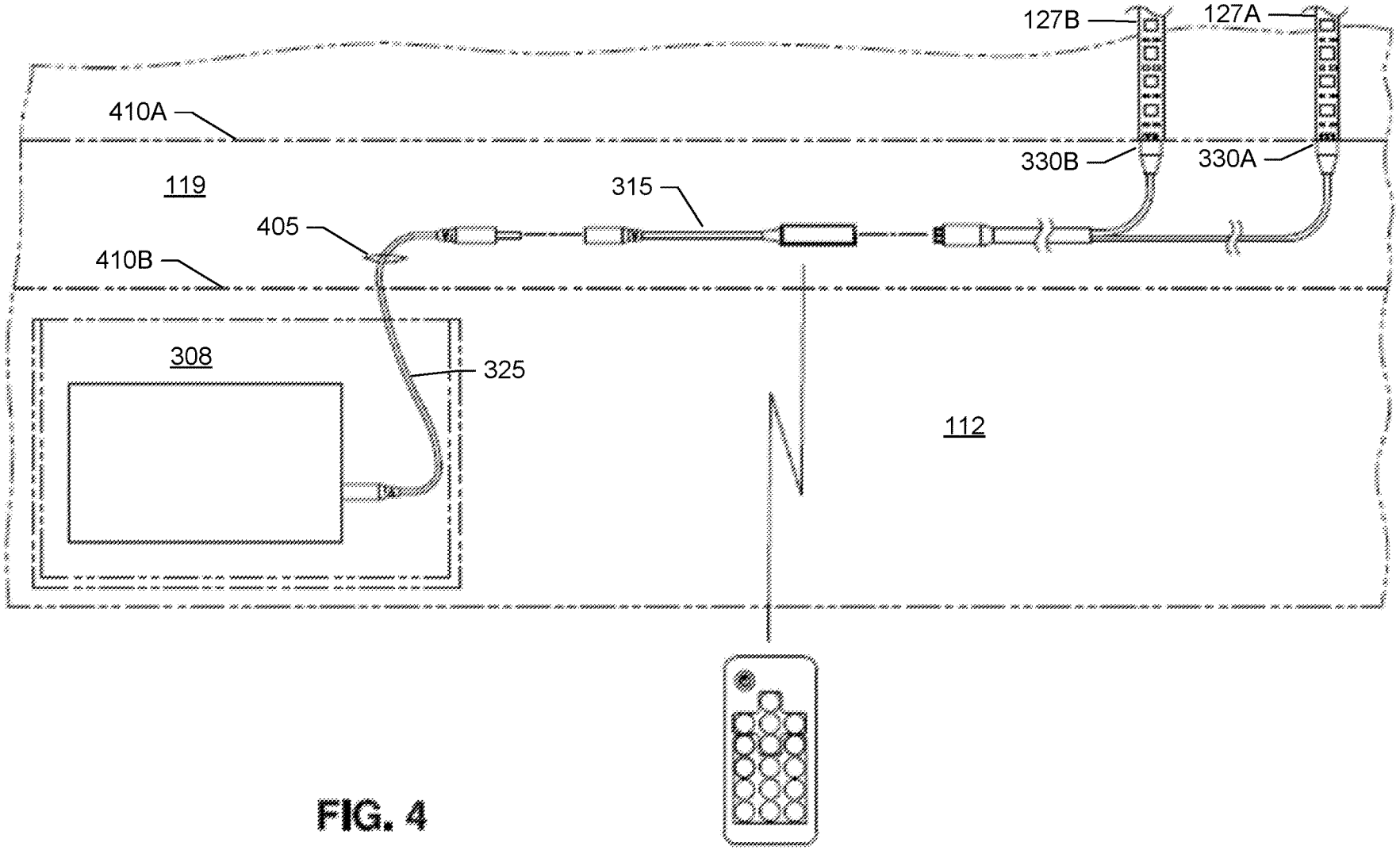
FIG. 4 shows an enlarged view of a section of the inside of the safety garment according to one or more embodiments.

FIG. 4 shows an enlarged view of an inside portion of the safety garment and the routing of the wiring assembly. As shown in the example of FIG. 4, there is wiring assembly 325, first and second ends 330A, B of the wiring assembly, first and second lighting strips 127A, B, optional lighting controller 315 connected inline to the wiring assembly, horizontal strip 119, base layer 112, and inside pocket 308.

While FIG. 4 shows the optional lighting controller concealed between the horizontal strip and base layer, it should be appreciated that the length of wires making up the wiring assembly may be sized and cut so that the controller is designed to be exposed or sit within the inside pocket. This allows the user easy access to the controller. If the controller is not needed or malfunctions, the user can remove the controller from the wiring assembly and reconnect the ends of the wiring assembly, previously connected to the controller, together. The connections of the controller may include a plug/socket type connection so that the controller can be easily removed and the wiring assembly easily reconnected.

As shown in the example of FIG. 4, the wiring assembly is routed through a first opening, hole, or slit 405 formed in the base layer. The first opening is located between top and bottom stitching 410A, B, respectively, used to attached the horizontal strip to the base layer. The wiring assembly proceeds through a sleeve formed between the horizontal strip and the base layer and towards the lighting strips where the respective ends of the lighting strips and wiring assembly are then connected. The sleeve may be a closed sleeve where ends of the sleeve have been stitched to the base layer.

Figure 4A:
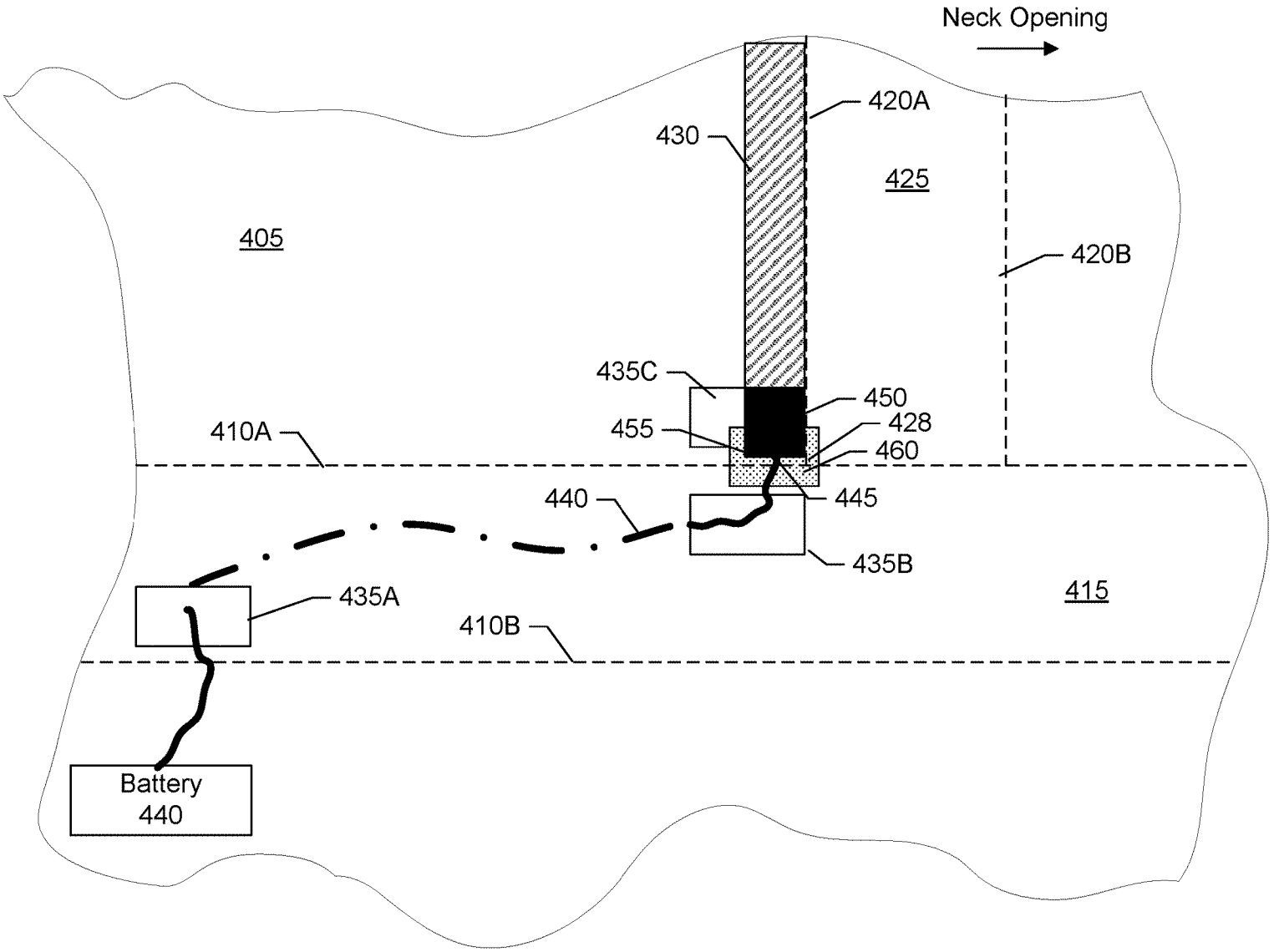
FIG. 4A shows another enlarged view of a section of the inside of the safety garment according to one or more embodiments.

FIG. 4A shows an enlarged inside view of the safety garment at the connection between the wiring assembly and lighting strip. As shown in FIG. 4A, there is a base layer 405. The view shown in FIG. 4A is of an inside surface of the base layer. Top and bottom horizontal stitches 410A, B attach a horizontal strip 415 to an outside surface of the base layer, opposite the inside surface of the base layer. Left and right vertical stitches 420A, B attach a vertical strip 425 to the outside surface of the base layer. An intersection 428 is formed by the vertical and horizontal strips meeting each other. A lighting strip 430 is attached to the outside surface of the base layer next to the vertical strip and along an outer edge of the vertical strip (i.e., an edge of vertical strip furthest from the neck opening of the safety garment).

As discussed, since the view of FIG. 4A shows the inside surface of the base layer, the lighting strips and vertical and horizontal strips will not be visible (or will be partially visible through a mesh fabric of the safety garment) because the strips are attached to the outside surface of the base layer.

FIG. 4A further shows first, second, and third openings 435A-C and a wiring assembly 440. The first opening is located proximate to or near a battery 440 and between the top and bottom horizontal stitches. The second opening is located proximate to or near the vertical strip and between the top and bottom horizontal stitching. Likewise, the third opening is located proximate to or near the vertical strip.

However, the third opening is above the top horizontal stitching. More particularly, the second and third openings may be closer to the vertical strip than the first opening. The second and third openings may be closer to the intersection of the horizontal and vertical strip than the first opening. The second opening is below the third opening. The third opening is above the second opening. The second and third openings may be made next to or at the intersection of the horizontal and vertical strips. The third opening is directly below an end of the lighting strip. The second opening is at an end of the lighting strip. In other words, the second opening may correspond to the end of the lighting strip. The end of the lighting strip may overlap with the second opening. The location of the openings helps to provide a clean routing of the wiring assembly and connection to the lighting strip.

For example, in a specific embodiment, a path of the wiring assembly from the battery is into first opening 435A. The first opening provides an opening into the sleeve formed by the horizontal strip and the base layer. The wiring assembly extends at a least a portion of a length of the sleeve and to second opening 435B. In FIG. 4A, a portion of the wiring assembly is shown using a dash-dot line to indicate that the portion of the wiring assembly is sandwiched or hidden between the horizontal strip and the base layer of the safety garment. An end 445 of the wiring assembly then exits through second opening 435B formed in the base layer.

Third opening 435C is at an end 450 of the lighting strip. The third opening exposes the end of the lighting strip to the inside of the safety garment so that a connection 455 can be made between the end of the lighting strip and end of the wiring assembly. In FIG. 4A, a portion of the lighting strip is shown with a slanted line pattern to indicate that portion of the lighting strip on the outside surface of the base layer. Another portion of the lighting strip is shown with a solid pattern to indicate that end portion of the lighting strip that is exposed or visible through third opening 435C (as viewed from the inside of the safety garment).

In specific embodiment, upon the ends of the wiring assembly and lighting strip being connected (e.g., electrically coupled such as via soldering), the connection may be sealed such as via heat shrinkable tubing or wrap 460. The heat shrinkable tubing is shown in FIG. 4A using pattern of dots. Sealing the connection within the heat shrinkable tubing helps to prevent moisture ingress and arcing.

Figure 6:
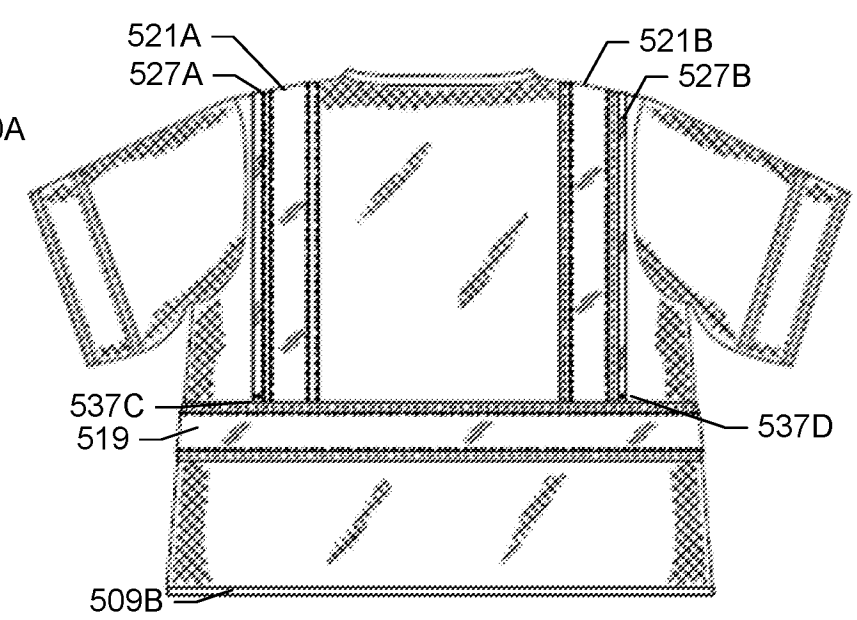
FIG. 6 shows a back view of the safety garment according to one or more embodiments.
Figure 5:
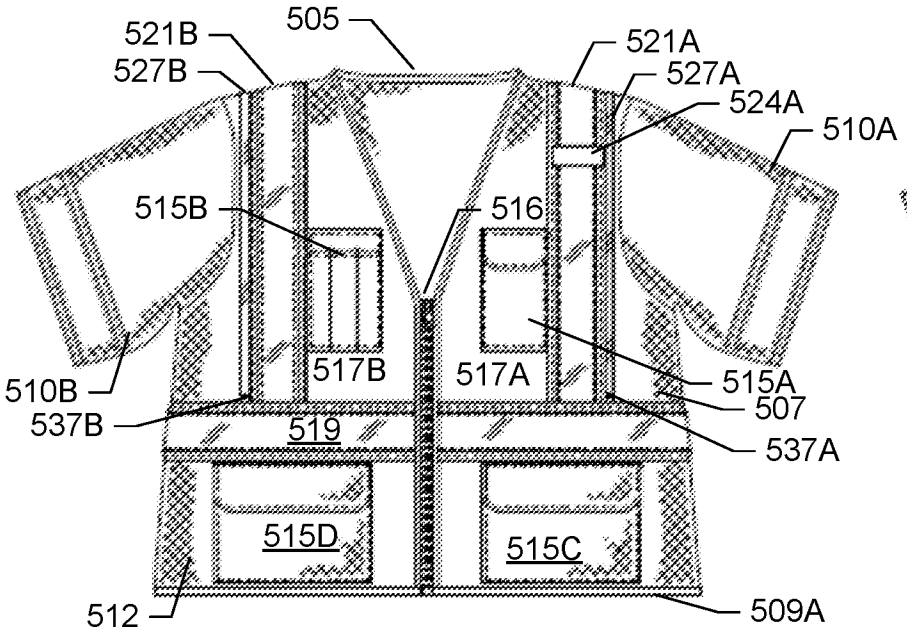
FIG. 5 shows a front view of another safety garment according to one or more embodiments.

FIGS. 5 and 6 show front and back views, respectively, of a safety garment 505 according to another specific embodiment. The safety garment shown in FIGS. 5 and 6 is similar to the safety garment shown in FIGS. 1 and 2. The safety garment shown in FIGS. 5 and 6, however, include a pair of short sleeves attached to the vest section and alternative design of the vertical strips.

More particularly, safety garment 505 includes a vest section 507 having a front 509A (FIG. 5) and a back 509B (FIG. 6), opposite the front, a pair of arm receiving openings 510A, B, a base layer fabric 512, and one or more pockets 515A-D attached to the base layer fabric. A fastening mechanism 516 on the front divides, splits, or bisects the front of the vest section into a left side 517A and a right side 517B (as viewed from a perspective of the user when the safety garment is worn).

Safety garment 505 satisfies the American National Standard for High-Visibility Safety Apparel and Accessories including ANSI/ISEA 107-2015, ANSI/ISEA 107-2010, or both. The safety garment includes a horizontal strip 519 attached to the base layer, a first vertical strip 521A attached to the base layer, a first reflective band 524A attached to the base layer and over the first vertical strip, a first lighting strip 527A attached to the base layer, a second vertical strip 521B attached to the base layer, and a second lighting strip 527B attached to the base layer.

The pair of vertical strips (e.g., first and second vertical strips 521A, B) begin at a top edge of a portion of the horizontal strip at the back of the garment (see, e.g., FIG. 6), continue up towards the shoulder portions of the vest section, and down the front, past an outside edge of pockets 515A, B, and terminate at a top edge of a portion of the horizontal strip that is at the front (see, e.g., FIG. 5).

The pair of lighting strips (e.g., first and second lighting strips 527A, B) follow along respective outer edges of the pair of vertical strips. Specifically, the pair of lighting strips begin at the top edge of the portion of the horizontal strip at the back of the garment (see, e.g., FIG. 6), continue up towards the shoulder portions of the vest section, and down the front, past pockets 515A, B, and terminate at the top edge of the portion of the horizontal strip that is at the front (see, e.g., FIG. 5).

The intersections formed by the meeting of the pair of vertical strips with the horizontal strip provide locations for connecting the ends of the lighting strips to the wiring assembly routed between the horizontal strip and base layer.

In the example shown in FIGS. 5 and 6, a first intersection 537A is formed at the front left side where the first vertical strip meets the horizontal strip. A second intersection 537B is formed at the front right side where the second vertical strip meets the horizontal strip. A third intersection 537C is formed at the back left side where the first vertical strip meets the horizontal strip. A fourth intersection 537D is formed at the back right side where the second vertical strip meets the horizontal strip.

Figure 7:
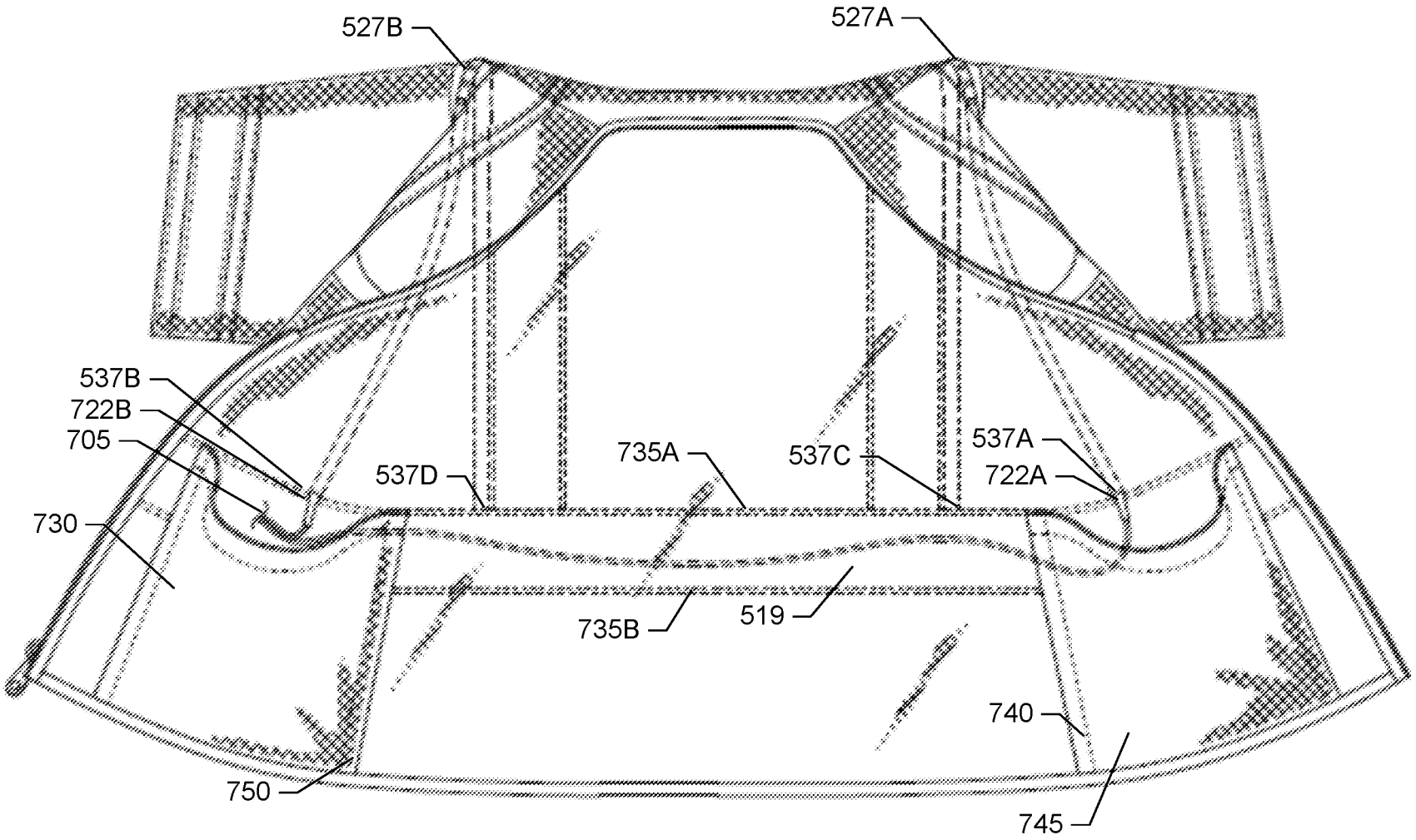
FIG. 7 shows an inside view of the safety garment according to one or more embodiments.

FIG. 7 shows an inside view of safety garment 505 and a routing of a wiring assembly 705 connecting ends of first and second lighting strips 527A, B. The routing of the wiring assembly and connection to the lighting strips is similar to the routing and connection shown in FIG. 4A. In the example of FIG. 7, however, the wiring assembly connects to ends of the lighting strips at the front.

More particularly, the wiring assembly includes first and second ends 722A, B. Another end of the wiring assembly, opposite the first and second ends, is connected to a battery that may be stored in a first inside pocket 730 attached to an inside surface of the base layer. At least a portion of the wiring assembly is routed through horizontal strip 519. As shown in the example of FIG. 7, in a specific embodiment, the first end of the wiring assembly is routed through an opening formed at an upper corner of the first inside pocket, and into another nearby opening formed between top and bottom stitches 735A, B, respectively, that attach the horizontal strip to the outside surface of the base layer.

The wiring assembly can then be routed from a battery side (or first inside pocket side) of the safety garment to an opposite side and within the sleeve formed between the horizontal strip and the base layer. The first end of the wiring assembly may be passed between a seam 740 attaching a second inside pocket 745 to an inside surface of the base layer. The first end of the wiring assembly may connect with an end of the first lighting strip at intersection 537A.

The second end of the wiring assembly may connect with an end of the second lighting strip at intersection 537B. It should be appreciated that there can be many different locations at which the wiring assembly may enter the closed sleeve formed between the horizontal strip and the base layer. For example, in another specific embodiment, an opening may be formed between top and bottom stitches 735A,B, where the opening is located within the first inside pocket. The wiring assembly may then be routed between a seam 750 attaching the first inside pocket to the inside surface of the base layer fabric. In another specific embodiment, one or more ends of the wiring assembly may connect to respective one or more ends of the lighting strips at respective one or more intersections located at the back (e.g., intersection 537C,D, or both).

Figure 8:
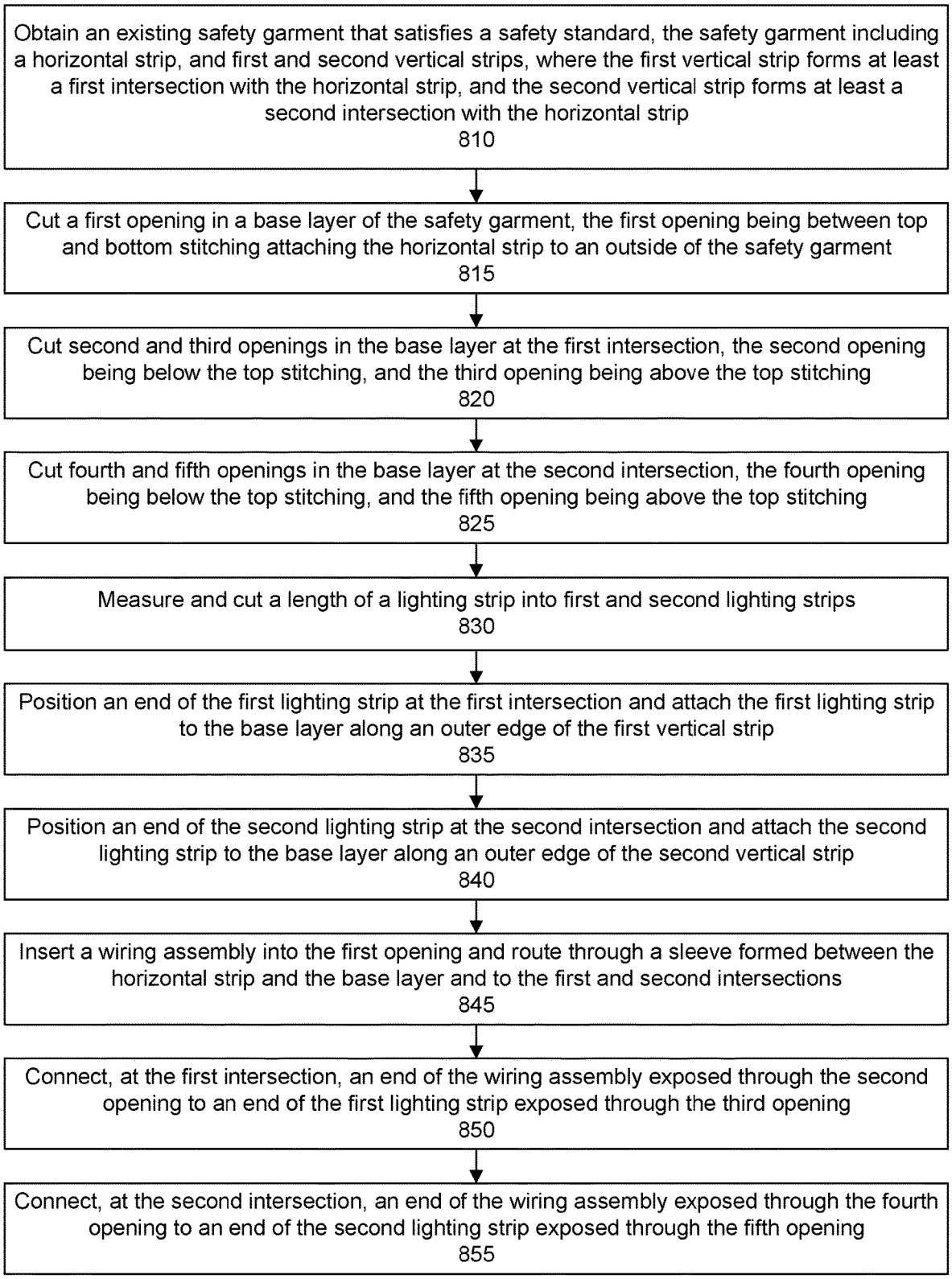
FIG. 8 shows an overall flow for making a safety garment with lights according to one or more embodiments.

FIG. 8 shows a flow for making a safety garment with lights according to one or more embodiments. Some specific flows are presented in this application, but it should be understood that the process is not limited to the specific flows and steps presented. For example, a flow may have additional steps (not necessarily described in this application), different steps which replace some of the steps presented, fewer steps or a subset of the steps presented, or steps in a different order than presented, or any combination of these. Further, the steps in other embodiments may not be exactly the same as the steps presented and may be modified or altered as appropriate for a particular process, application or based on the data.

In a specific embodiment, the safety garment with lights is constructed by modifying an existing safety garment. In a specific embodiment, the existing safety garment satisfies a safety standard. That is, the existing safety garment before the modification may satisfy the safety standard. The standard may be ANSI/ISEA 107-2015, ANSI/ISEA 107-2010, or both. The modification may include adding lighting strips to the existing safety garment using techniques described herein.

More specifically, in a step 810, an existing safety garment is obtained that satisfies a safety standard. The safety garment may include a horizontal strip, a first vertical strip, and a second vertical strip. In other words, these strips may already have been attached (e.g., sewn) to a base layer of the existing safety garment. The existing safety garment may be available and sold as a finished product. One or more of the horizontal, first vertical, or second vertical strips may include a background strip that is of a color that contrasts with a color of a base layer of the safety garment. One or more of the horizontal, first vertical, or second vertical strips may include a strip of reflective material coupled to the background strip.

The first vertical strip forms at least a first intersection with the horizontal strip. For example, an end of the first vertical strip may meet a top edge of the horizontal strip. The first vertical strip may extend past the top edge of the horizontal strip. The vertical strip may contact the horizontal strip.

The second vertical strip forms at least a second intersection with the horizontal strip. For example, an end of the second vertical strip may meet the top edge of the horizontal strip. The second vertical strip may extend past the top edge of the horizontal strip.

In a step 815, a first opening, hole, or slit is cut into a base layer of the safety garment. For example, the opening may be cut using a razor blade. The first opening is located such that it is between top and bottom stitching attaching the horizontal strip to an outside of the safety garment. The first opening may be located near an inside pocket of the safety garment in which a battery is to be stored.

In a step 820, second and third openings, holes, or slits are cut into the base layer at the first intersection. The second opening is located at the first intersection such that it is below the top stitching. The third opening is located at the first intersection such that it is above the top stitching.

In a step 825, fourth and fifth openings, holes, or slits are cut into the base layer at the second intersection. The fourth opening is located at the second intersection such that it is below the top stitching. The fifth opening is located at the second intersection such that it is above the top stitching In a step 830, a length of lighting strip is measured and cut into first and second lighting strips. A length of a lighting strip may be equal to a length of a vertical strip. A length of a lighting strip may be different from a length of a vertical strip. A length of a lighting strip may be sufficient to be placed at an intersection located at one of a front or back of the safety garment and extend over a shoulder portion of the safety garment and down at least a portion of a length of another of the front or back of the safety garment.

In a step 835, an end of the first lighting strip is positioned at the first intersection. The first lighting strip is attached to the base layer along an outer edge of the first vertical strip.

In a step 840, an end of the second lighting strip is positioned at the second intersection. The second lighting strip is attached to the base layer along an outer edge of the second vertical strip.

In a step 845, a wiring assembly or end of the wiring assembly is inserted into the first opening. The wiring assembly is routed through a sleeve formed between the horizontal strip and the base layer and to the first and second intersections.

In a step 850, at the first intersection, an end of the wiring assembly exposed through the second opening is connected to an end of the first lighting strip exposed through the third opening.

In a step 855, at the second intersection, an end of the wiring assembly exposed through fourth opening is connected to an end of the second lighting strip exposed through the fifth opening. These connections may be sealed for protection such as via heat shrinkable tubing, shrink wrap, electrical tape, or other. Any openings cut into the base layer fabric may be reinforced to prevent edges of the openings from fraying or further tearing. For example, grommets or tape may be placed over one or more openings.

Constructing the lighted safety garment from an existing safety garment that has already satisfied a safety standard can help to speed adoption in the workplace. For example, the safety garment with lights as disclosed herein may not be required to undergo additional certification or may proceed along a fast-tracked certification process.

Figures A-L in the appendix show various views of a safety garment with lights according to one or more embodiments.

In a specific embodiment, a safety garment includes: a vest section comprising a base layer, a front, and a back, opposite the front, the front being split into a left side and a right side, opposite the left side; a fastening mechanism on the front that removeably joins the left and right sides to form a neck opening; a horizontal strip, coupled to the base layer, and comprising a horizontal background strip, and a horizontal reflective strip, the horizontal background strip having a color that contrasts with a color of the base layer, and extending substantially around the front and back of the vest section, starting at a first half of the fastening mechanism and terminating at a second half of the fastening mechanism; a first vertical strip, coupled to the base layer, and comprising a first vertical background strip, and a first vertical reflective strip, the first vertical background strip having a color that contrasts with the color of the base layer, and extending from the back of the vest section, over a left shoulder portion of the safety garment, and towards a portion of the horizontal strip that is at the front of the vest section; a first strip of light emitting diodes (LEDs), coupled to the base layer, extending along at least a portion of a first outer edge of the first vertical strip; a second vertical strip, coupled to the base layer, and comprising a second vertical background strip, and a second vertical reflective strip, the second vertical background strip having a color that contrasts with the color of the base layer, and extending from the back of the vest section, over a right shoulder portion of the safety garment, and towards the portion of the horizontal strip that is at the front of the vest section; a second strip of LEDs, coupled to the base layer fabric, extending along at least a portion of a second outer edge of the second vertical strip; a battery; and a wiring assembly, coupled to the battery, and comprising first and second ends, the first end of the wiring assembly is coupled to an end of the first strip of LEDs, and the second end of the wiring assembly is coupled to an end of the second strip of LEDs, wherein at least a portion of the wiring assembly is sandwiched between the base layer and the horizontal strip, wherein the first outer edge of the first vertical strip, along which the first strip of LEDs extends, is further from the neck opening than a first inner edge of the first vertical strip, opposite the first outer edge, and wherein the second outer edge of the second vertical strip, along which the second strip of LEDs extends, is further from the neck opening than a second inner edge of the second vertical strip, opposite the second outer edge.

The safety garment may include short sleeves coupled to the vest section.

In an embodiment, the first and second vertical strips start at a bottom edge of the back of the vest section, and intersect and pass under the horizontal strip, wherein the first end of the wiring assembly is coupled to the end of the first strip of LEDs at a first intersection formed between the first vertical strip and the horizontal strip, and wherein the second end of the wiring assembly is coupled to the end of the second strip of LEDs at a second intersection formed between the second vertical strip and the horizontal strip.

In an embodiment, the first strip of LEDs and the first vertical strip both begin at a first intersection formed with the horizontal strip, wherein the second strip of LEDs and the second vertical strip both begin at a second intersection formed with the horizontal strip, wherein the first end of the wiring assembly is coupled to the end of the first strip of LEDs at the first intersection, and wherein the second end of the wiring assembly is coupled to the end of the second strip of LEDs at the second intersection.

In an embodiment, lengths of first and second strips of LEDs and first and second vertical strips are equal to each other. In an embodiment, a first distance is between the first outer edge of the first vertical strip and the second outer edge of the second vertical strip, wherein a second distance is between the first inner edge of the first vertical strip and the second inner edge of the second vertical strip, and wherein the first distance is greater than the second distance.

In an embodiment, the first strip of LEDs, second strip of LEDs, first vertical strip, and second vertical strip are parallel to each other. In an embodiment, the first strip of LEDs, second strip of LEDs, first vertical strip, and second vertical strip are orthogonal to the horizontal strip.

In an embodiment, there is a first opening cut into the base layer, the first opening being located between top and bottom stitching coupling the horizontal strip to the base layer; and a second opening cut into the base layer, the second opening being located above the top stitching, wherein one of the first or second ends of the wiring assembly exits out through first opening, and wherein the one of the first or second ends of the wiring assembly connects to one of the end of the first strip of LEDs or the end of the second strip of LEDs via the second opening. In an embodiment, there is a pocket on an inside of the safety garment in which the battery is stored. The base layer may include a mesh material.

In an embodiment, the safety garment includes an LED controller, coupled between the battery and the first and second ends of the wiring assembly; and a wireless remote control, paired with the LED controller, to control operation of the first and second strips of LEDs.

In an embodiment, the safety garment includes: a first pocket on the left side of the front and positioned above the horizontal strip; a second pocket on the left side of the front and positioned below the horizontal strip; a third pocket on the right side of the front and positioned above the horizontal strip; and a fourth pocket on the right side of the front and positioned below the horizontal strip.

The first vertical strip may terminate at the first pocket, and the second vertical strip may terminate at the third pocket. The first vertical strip may extend past the first pocket, and the second vertical strip may extend past the third pocket.

The first and second strip of LEDs may drape over respective left and right shoulder portions of the vest section to highlight shoulders and a shoulder width of a human form. The first and second strip of LEDs may extend along opposite sides of vest section to highlight an elongated torso of a human form. In an embodiment, the lighting elements of the first strip of LEDs are arranged along a first single line, lighting elements of the second strip of LEDs are arranged along a second single line, and the second single line is parallel to the first single line.

In an embodiment, an edge of the first strip of LEDs contacts the first outer edge of the first vertical strip, and an edge of the second strip of LEDs contacts the second outer edge of the second vertical strip.

In another specific embodiment, there is a safety garment including: a vest section comprising a base layer, a front, and a back, opposite the front; a horizontal strip, coupled to the base layer, and extending substantially around the front and back of the vest section; a first vertical strip, coupled to the base layer, and forming at least a first intersection with the horizontal strip; a first strip of light emitting diodes (LEDs), coupled to the base layer, and extending from the first intersection, perpendicular to the horizontal strip, and along at least a portion of an outer edge of the first vertical strip; a second vertical strip, coupled to the base layer, opposite the first vertical strip, and forming at least a second intersection with the horizontal strip; a second strip of LEDs, coupled to the base layer, and extending from the second intersection, perpendicular to the horizontal strip, and along at least a portion of an outer edge of the second vertical strip; and a wiring assembly comprising first and second ends, the first end of the wiring assembly is coupled to an end of the first strip of LEDs at the first intersection, and the second end of the wiring assembly is coupled to an end of the second strip of LEDs at the second intersection, and wherein at least a portion of the wiring assembly is routed between the base layer and the horizontal strip.

In an embodiment, the vest section comprises a neck opening, and a distance between the neck opening and the outer edge of the first vertical strip along which the first strip of LEDs extends is greater than a distance between the neck opening and an inner edge of the first vertical strip.

In an embodiment, the safety garment includes first and second openings in the base layer at the first intersection, wherein the first opening is between top and bottom stitching coupling the horizontal strip to the base layer, and the second opening is above the top stitching, wherein the first end of the wiring assembly exits through the first opening, and wherein the end of the first strip of LEDs is exposed through the second opening to connect the first end of the wiring assembly to the end of the first strip of LEDs.

In another specific embodiment, there is a method comprising: obtaining a safety garment that meets a safety standard, the safety garment comprising: a base layer having a front, and a back, opposite the front; a horizontal strip, coupled to the base layer, and extending substantially around the safety garment; a first vertical strip, coupled to the base layer, intersecting the horizontal strip to form a first intersection, and extending down at least portions of the front and back of the base layer; and a second vertical strip, coupled to the base layer, intersecting the horizontal strip to form a second intersection, extending parallel to the first vertical strip, and down at least portions of the front and back of the base layer; attaching a first light emitting diode (LED) strip to the base layer, starting at the first intersection and extending along at least a portion of a length of an outer edge of the first vertical strip; attaching a second LED strip to the base layer, starting at the second intersection and extending along at least a portion of a length of an outer edge of the second vertical strip; cutting a first hole in the base layer, the first hole being between top and bottom stitching coupling the horizontal strip to the base layer; cutting second and third holes in the base layer at the first intersection, the second hole being between the top and bottom stitching, and the third hole being above the top stitching; cutting fourth and fifth holes in the base layer at the second intersection, the fourth hole being between the top and bottom stitching, and the fifth hole being above the top stitching; routing a wiring assembly into the first hole and towards the first and second intersections; allowing a first end of the wiring assembly to exit through the second hole at the first intersection; connecting the first end of the wiring assembly to an end of the first LED strip exposed through the third hole; allowing a second end of the wiring assembly to exit through the fourth hole at the second intersection; and connecting the second end of the wiring assembly to an end of the second LED strip exposed through the fifth hole.

In an embodiment, the safety garment includes a neck opening, a first distance is between the neck opening and the outer edge of the first vertical strip, a second distance is between the neck opening and an inner edge of the first vertical strip, and the first distance is greater than the second distance.

In the description above and throughout, numerous specific details are set forth in order to provide a thorough understanding of an embodiment of this disclosure. It will be evident, however, to one of ordinary skill in the art, that an embodiment may be practiced without these specific details. In other instances, well-known structures and devices are shown in block diagram form to facilitate explanation. The description of the preferred embodiments is not intended to limit the scope of the claims appended hereto. Further, in the methods disclosed herein, various steps are disclosed illustrating some of the functions of an embodiment. These steps are merely examples, and are not meant to be limiting in any way. Other steps and functions may be contemplated without departing from this disclosure or the scope of an embodiment.

What is claimed is:

1. A safety garment comprising:

a vest section comprising a base layer, a front, and a back, opposite the front, the front being split into a left side and a right side, opposite the left side;

a fastening mechanism on the front that removeably joins the left and right sides to form a neck opening;

a horizontal strip, coupled to the base layer, and comprising a horizontal background strip, and a horizontal reflective strip, the horizontal background strip having a color that contrasts with a color of the base layer, and extending substantially around the front and back of the vest section, starting at a first half of the fastening mechanism and terminating at a second half of the fastening mechanism;

a first vertical strip, coupled to the base layer, and comprising a first vertical background strip, and a first vertical reflective strip, the first vertical background strip having a color that contrasts with the color of the base layer, and extending from the back of the vest section, over a left shoulder portion of the safety garment, and towards a portion of the horizontal strip that is at the front of the vest section;

a first strip of light emitting diodes (LEDs), coupled to the base layer, extending along at least a portion of a first outer edge of the first vertical strip;

a second vertical strip, coupled to the base layer, and comprising a second vertical background strip, and a second vertical reflective strip, the second vertical background strip having a color that contrasts with the color of the base layer, and extending from the back of the vest section, over a right shoulder portion of the safety garment, and towards the portion of the horizontal strip that is at the front of the vest section;

a second strip of LEDs, coupled to the base layer, extending along at least a portion of a second outer edge of the second vertical strip;

a battery; and a wiring assembly, coupled to the battery, and comprising first and second ends, the first end of the wiring assembly is coupled to an end of the first strip of LEDs, and the second end of the wiring assembly is coupled to an end of the second strip of LEDs, wherein at least a portion of the wiring assembly is sandwiched between the base layer and the horizontal strip, wherein the first outer edge of the first vertical strip, along which the first strip of LEDs extends, is further from the neck opening than a first inner edge of the first vertical strip, opposite the first outer edge, and wherein the second outer edge of the second vertical strip, along which the second strip of LEDs extends, is further from the neck opening than a second inner edge of the second vertical strip, opposite the second outer edge; a first opening cut into the base layer, the first opening being located between top and bottom stitching coupling the horizontal strip to the base layer; and a second opening cut into the base layer, the second opening being located above the top stitching, wherein one of the first or second ends of the wiring assembly exits out through first opening, and wherein the one of the first or second ends of the wiring assembly connects to one of the end of the first strip of LEDs or the end of the second strip of LEDs via the second opening.

2. The safety garment of claim 1 comprising short sleeves coupled to the vest section.

3. The safety garment of claim 1 wherein the first and second vertical strips start at a bottom edge of the back of the vest section, and intersect and pass under the horizontal strip, wherein the first end of the wiring assembly is coupled to the end of the first strip of LEDs at a first intersection formed between the first vertical strip and the horizontal strip, and wherein the second end of the wiring assembly is coupled to the end of the second strip of LEDs at a second intersection formed between the second vertical strip and the horizontal strip.

4. The safety garment of claim 1 wherein the first strip of LEDs and the first vertical strip both begin at a first intersection formed with the horizontal strip, wherein the second strip of LEDs and the second vertical strip both begin at a second intersection formed with the horizontal strip, wherein the first end of the wiring assembly is coupled to the end of the first strip of LEDs at the first intersection, and wherein the second end of the wiring assembly is coupled to the end of the second strip of LEDs at the second intersection.

5. The safety garment of claim 1 wherein lengths of first and second strips of LEDs and first and second vertical strips are equal to each other.

6. The safety garment of claim 1 wherein a first distance is between the first outer edge of the first vertical strip and the second outer edge of the second vertical strip, wherein a second distance is between the first inner edge of the first vertical strip and the second inner edge of the second vertical strip, and wherein the first distance is greater than the second distance.

7. The safety garment of claim 1 wherein the first strip of LEDs, second strip of LEDs, first vertical strip, and second vertical strip are parallel to each other.

8. The safety garment of claim 1 wherein the first strip of LEDs, second strip of LEDs, first vertical strip, and second vertical strip are orthogonal to the horizontal strip.

9. The safety garment of claim 1 comprising a pocket on an inside of the safety garment in which the battery is stored.

10. The safety garment of claim 1 wherein the base layer comprises a mesh material.

11. The safety garment of claim 1 comprising:

an LED controller, coupled between the battery and the first and second ends of the wiring assembly; and a wireless remote control, paired with the LED controller, to control operation of the first and second strips of LEDs.

12. The safety garment of claim 1 wherein the first and second strip of LEDs drape over respective left and right shoulder portions of the vest section, and extend along opposite sides of the vest section to highlight shoulders of a human form, a shoulder width of the human form, and an elongated torso of the human form.

13. The safety garment of claim 12 wherein lighting elements of the first strip of LEDs are arranged along a first single line, lighting elements of the second strip of LEDs are arranged along a second single line, and the second single line is parallel to the first single line.

14. The safety garment of claim 1 wherein an edge of the first strip of LEDs contacts the first outer edge of the first vertical strip, and an edge of the second strip of LEDs contacts the second outer edge of the second vertical strip.

15. A safety garment comprising:

a vest section comprising a base layer, a front, and a back, opposite the front;

a horizontal strip, coupled to the base layer, and extending substantially around the front and back of the vest section;

a first vertical strip, coupled to the base layer, and forming at least a first intersection with the horizontal strip;

a first strip of light emitting diodes (LEDs), coupled to the base layer, and extending from the first intersection, perpendicular to the horizontal strip, and along at least a portion of an outer edge of the first vertical strip;

a second vertical strip, coupled to the base layer, opposite the first vertical strip, and forming at least a second intersection with the horizontal strip;

a second strip of LEDs, coupled to the base layer, and extending from the second intersection, perpendicular to the horizontal strip, and along at least a portion of an outer edge of the second vertical strip; and a wiring assembly comprising first and second ends, the first end of the wiring assembly is coupled to an end of the first strip of LEDs at the first intersection, and the second end of the wiring assembly is coupled to an end of the second strip of LEDs at the second intersection, and wherein at least a portion of the wiring assembly is routed between the base layer and the horizontal strip first and second openings in the base layer at the first intersection, wherein the first opening is between top and bottom stitching coupling the horizontal strip to the base layer, and the second opening is above the top stitching, wherein the first end of the wiring assembly exits through the first opening, and wherein the end of the first strip of LEDs is exposed through the second opening to connect the first end of the wiring assembly to the end of the first strip of LEDs.

16. The safety garment of claim 15 wherein the vest section comprises a neck opening, and a distance between the neck opening and the outer edge of the first vertical strip along which the first strip of LEDs extends is greater than a distance between the neck opening and an inner edge of the first vertical strip.

17. A method comprising:

obtaining a safety garment that meets a safety standard, the safety garment comprising:

a base layer having a front, and a back, opposite the front;

a horizontal strip, coupled to the base layer, and extending substantially around the safety garment;

a first vertical strip, coupled to the base layer, intersecting the horizontal strip to form a first intersection, and extending down at least portions of the front and back of the base layer; and a second vertical strip, coupled to the base layer, intersecting the horizontal strip to form a second intersection, extending parallel to the first vertical strip, and down at least portions of the front and back of the base layer;

attaching a first light emitting diode (LED) strip to the base layer, starting at the first intersection and extending along at least a portion of a length of an outer edge of the first vertical strip;

attaching a second LED strip to the base layer, starting at the second intersection and extending along at least a portion of a length of an outer edge of the second vertical strip;

cutting a first hole in the base layer, the first hole being between top and bottom stitching coupling the horizontal strip to the base layer;

cutting second and third holes in the base layer at the first intersection, the second hole being between the top and bottom stitching, and the third hole being above the top stitching;

cutting fourth and fifth holes in the base layer at the second intersection, the fourth hole being between the top and bottom stitching, and the fifth hole being above the top stitching;

routing a wiring assembly into the first hole and towards the first and second intersections;

allowing a first end of the wiring assembly to exit through the second hole at the first intersection;

connecting the first end of the wiring assembly to an end of the first LED strip exposed through the third hole;

allowing a second end of the wiring assembly to exit through the fourth hole at the second intersection; and connecting the second end of the wiring assembly to an end of the second LED strip exposed through the fifth hole.

18. The method of claim 17 wherein the safety garment comprises a neck opening, a first distance is between the neck opening and the outer edge of the first vertical strip, a second distance is between the neck opening and an inner edge of the first vertical strip, and the first distance is greater than the second distance.

* * * * *